United States Patent [19]

Titus

[11] Patent Number: 4,631,048

[45] Date of Patent: Dec. 23, 1986

[54] METHOD AND APPARATUS FOR PNEUMATICALLY EVACUATING CENTRIFUGES

[75] Inventor: Hans-Joachim Titus, Dornach, Fed. Rep. of Germany

[73] Assignee: Krauss-Maffei Aktiengesellschaft, Munich, Fed. Rep. of Germany

[21] Appl. No.: 662,020

[22] Filed: Oct. 18, 1984

[30] Foreign Application Priority Data

Nov. 10, 1983 [DE] Fed. Rep. of Germany ..... 3340636

[51] Int. Cl.[4] ..... B04B 15/02

[52] U.S. Cl. ..... 494/13; 494/37; 494/56; 494/58

[58] Field of Search ..... 494/13, 14, 37, 55, 494/56, 57, 58, 59, 60, 61, 85

[56] References Cited

U.S. PATENT DOCUMENTS

| | | | |
|---|---|---|---|
| 1,321,288 | 11/1919 | Dalzell | 494/13 |
| 2,215,624 | 9/1940 | Strezynski | 494/13 |
| 2,488,747 | 11/1949 | Strezynski | 494/59 |
| 2,720,313 | 10/1955 | Pattison | 494/13 |

*Primary Examiner*—Robert W. Jenkins

*Attorney, Agent, or Firm*—Shlesinger Arkwright Garvey & Fado

[57] ABSTRACT

A method and an apparatus for pneumatically evacuating a vertical centrifuge (12), the drying gas moving as a secondary flow (54) being converted—prior to its combination with the mixture of product and gas conveyed through the discharge pipe—into a turbulent longitudinal flow essentially enclosing the discharge pipe as far as its downstream end, in order to prevent caking of the centrifuged material within the discharge pipe or in conveying lines (20) attached thereto and also to shorten the length of the drying pipe.

13 Claims, 3 Drawing Figures

METHOD AND APPARATUS FOR PNEUMATICALLY EVACUATING CENTRIFUGES

Figure 1:
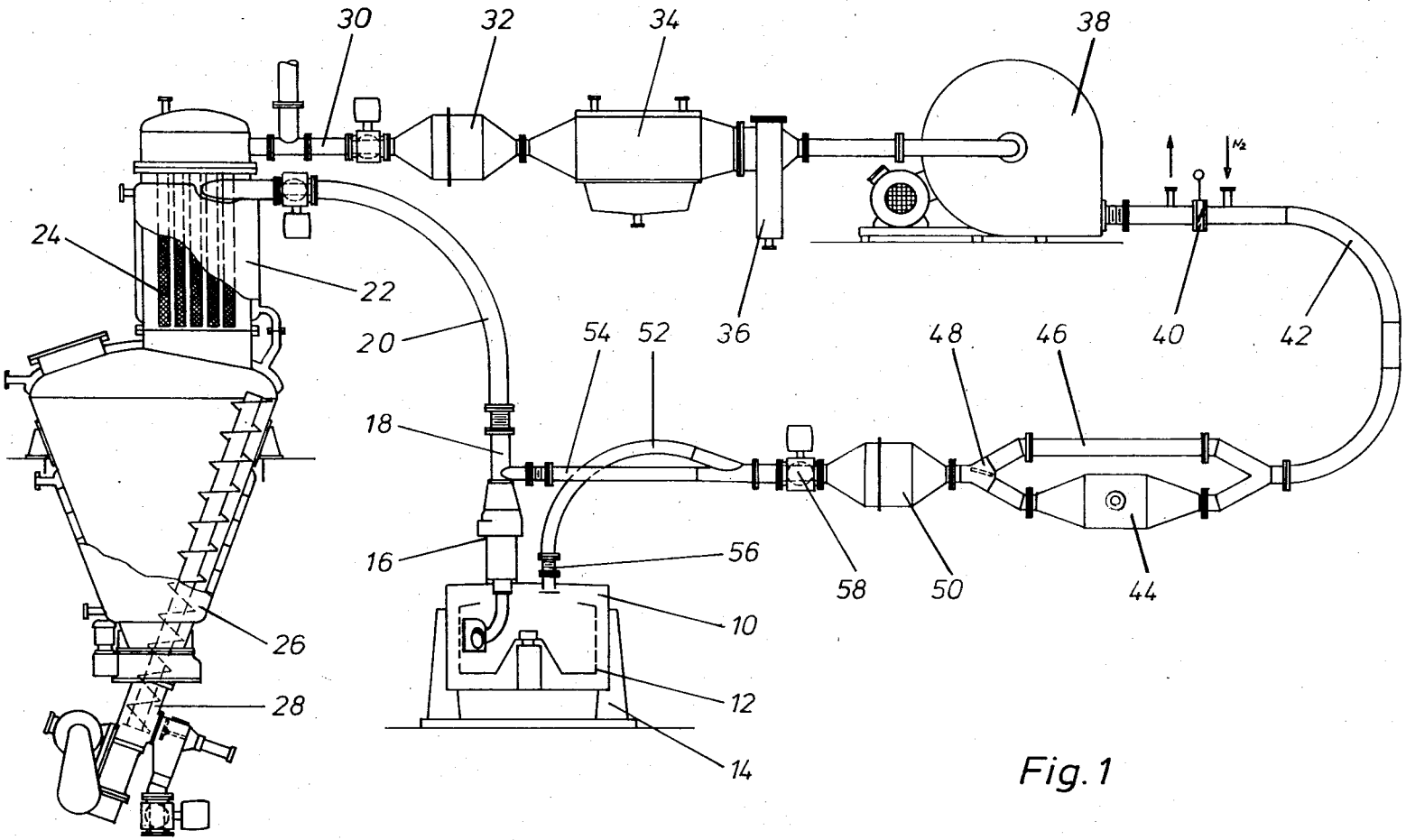

The invention concerns a method for evacuating centrifuges, in particular vertical centrifuges, wherein the centrifuged product is peeled off the wall of the rotating centrifuging drum and thus fed into a discharge pipe passing through the closed centrifuge housing, and wherein heated drying gas is fed in a primary flow into the centrifuge and in a secondary flow in a drying path communicating with the discharge pipe and guiding the mixture of product and gas.

In a method of the above cited type known from German Pat. No. 20 56 893, the gas-tight centrifuge housing of a centrifuge to be evacuated is included in a closed feed loop, a heated drying gas being introduced by means of a pressurized line into the centrifuge, and a discharge tube connected to a peeler head being connected to a suction line, in order that the product expelled from the centrifuge by a gas circulating device be fed through a drying path to a cyclone filter bin. In this manner the product, which might have to be kept sterile, or is sensitive or toxic, is peeled off of the centrifuging drum and conveyed further within a closed loop, without volatilized solvents coming into contact with the surrounding air during the processing.

It is suggested in a variation of this method to directly connect the outlet of the heater means mounted in the closed conveyance loop and used to reheat the drying gas cooled in the condenser to the suction line by means of a shunt line, whereby the centrifuge thus will be partly by-passed. This kind of gas guidance is to be used with relatively wet centrifuged products tending to cake, so that drying may begin during the peeling and discharge phase.

The implementation of this known method incurs the drawback that the line connecting the centrifuge and the intake of the by-pass into the main tube remains without effect as regards drying the product and merely amounts to a pneumatic conveying path. The mixture of product and gas coming from the centrifuge may very soon cool to the dew point of the solvent on this conveyance path, whereby the moist product cakes within the tube and causes clogging already after short times of operation, resulting in costly equipment shut-downs, besides the possible contamination to all of the charge being processed where ultimately sterile products are concerned. In order to avoid excessive cooling, it is necessary to raise the entry temperature of the drying gas in the centrifuge, whereby illustratively products of low melting points cake on the inside walls at the transition of one tube to the next of a telescope system used to adjust the discharge and peeling pipe in the centrifuging drum, thereby rendering impossible any further adjusting motion for the discharge pipe.

It is furthermore found in the practice relating to the known method that the product cakes in the area of the inlet of the conveyance path to the drying pipe, the drying gas fed by the secondary flow pressing the partly still product moist against the wall opposite the inlet or causing it to fuse there. In this respect too there is always the danger of extensive pipe clogging with consequent high costs for cleaning and other work.

It is the object of the invention to develop further and to improve the initially cited method for evacuating centrifuges so that caking of the product being conveyed is substantially avoided within the discharge pipe and/or in the connecting conveyance line, and in that furthermore the equipment expenditure is reduced by shortening the required length of the drying pipe.

This problem is solved by the invention in that the drying gas guided in the secondary flow prior to being combined with the mixture of gas and product conveyed through the discharge pipe is converted into a turbulent longitudinal flow essentially concentrically enveloping the discharge pipe as far as its downstream end.

The amount of drying gas fed into the secondary flow and concentrically enclosing the mixture of product and gas at the exit of the discharge pipe provides for effective turbulence whereby a maximal exchange takes place between the hot drying gas and the moistness of the product. This process can be roughly compared with the principle of flash drying, whereby also the length of pipe otherwise required for flow drying is substantially shortened. Because the secondary flow is moved concentrically about the discharge pipe before being combined with the mixture of product and gas, the advantageous possibility is given to keep a high temperature in the secondary flow, this heat being passed on either to the discharge pipe before the combination with the mixture of product and gas, or else being extensively introduced into the said mixture where for instance a product sensitive to abrupt temperature changes was pre-dried on its way from the centrifuging drum through the discharge pipe, i.e. when it was already partly heated. In this case too there results an advantageously shortened length of the drying pipe to dryly separate the product discharged from the centrifuge in the subsequent cyclone bin filter. These features resulting from the application of the method of the invention are especially significant if frequently varying products are being centrifuged, in order to fill the processing facility with the maximum load.

Another object of the invention furthermore is a pneumatic discharge apparatus in particular for a vertical centrifuge to carry out the above described method of the invention. The state of the art is represented by a discharge apparatus of the already above cited German patent 20 56 893 with a discharge pipe equipped with a peeling head at the leading end and movable within a centrifugal drum, with a centrifuge housing included in a pneumatic conveyance loop and with a connecting chamber mounted thereon in sealed manner within which is guided the discharge pipe and wherein are mounted radially and axially adjusting means for this discharge pipe.

In order to achieve the improvement of the method of the invention relating to drying when the drying path is shortened and to avoid product caking and locking of the adjustment means of the peeling head, it is proposed that the drying gas in the secondary flow is converted—prior to being combined with the mixture of product and gas conveyed through the discharge pipe—into a turbulent longitudinal flow essentially concentrically enclosing the discharge pipe as far as its downstream end.

Because the enclosing pipe for the secondary flow of the drying gas is directly flanged against the rear end of the connecting chamber and because it merges downstream into the drying path, the upper end of the connecting chamber, namely the downstream end, is made tight with respect to the surrounding atmosphere. This circumstance is exploited by the invention to pass the connecting pipe without interruption or telescoping extension through the entire connecting housing and in particular to pass it through the free end of the connecting end while being tight at the end away from the flow, and to let it enter the enclosing pipe. In the absence of the enclosing pipe, hermeticity would require introducing the drying pipe leading to the cyclone bin filter (suction line of the pneumatic conveying loop) in rigid and statically sealed manner into the upper end of the connecting housing wherein it would be combined with a telescoping discharge pipe in order to assure the required freedom of motion for adjusting the discharge pipe and the peeling elbow mounted thereat, that is, for both the longitudinal and the rotational motions of the discharge pipe. The diameter widening which perforce takes place in such an arrangement between the discharge pipe and the suction line connection introduces at this location an undesired gas turbulence and caking of the product on the pipe walls. Such cakings block the adjustment motions of the discharge pipe. The proposal of the invention both eliminates these operational difficulties and simultaneously achieves substantial savings in construction. Undesired turbulence and cakings no longer take place within an uninterrupted discharge pipe which thereby does not change in diameter. As regards sealing, one obtains the great advantage that the discharge pipe can be externally fine-ground and polished and also can be extraordinarily well sealed using a seal mounted at the upper end of the connecting chamber. This seal and the fine-ground circumference of the discharge pipe offer the further advantage that the annular space formed with the enclosing pipe can be kept free, by means of the secondary flow of the drying gas, of the danger of product dust otherwise possibly dropping back due to a widening in the diameter. The subsequently introduced drying gas flows concentrically with the inner discharge pipe in the upward direction and subjects to turbulence the mixture of gas and product issuing from the discharge pipe for the purpose of additional and intensive drying. It is understood of course that the enclosing pipe for the secondary flow of the drying gas in principle can also be used concentrically with a conveyor pipe rigidly mounted at the upper end of the connecting chamber if for other reasons the advantageous design of the connecting housing with the discharge pipe passing through it must be forfeited.

One embodiment of the discharge apparatus of the invention connects the intake pipe stub directly behind the free end of the connecting chamber and laterally to the enclosing pipe. This assures that the secondary flow preserves in any event the lower end of the annular space in the enclosing pipe from product depositions and thereby also assures the crossing by the discharge pipe and its sealing.

The intake pipe stub for the secondary flow of the drying gas can be connected to the enclosing pipe essentially perpendicularly to this pipe's axis in order to concentrically guide the secondary flow already for a small axial length. If required on other grounds, the intake pipe stub also can be joined in slanted and/or tangential manner to the enclosing pipe.

In another feature of the invention, a closing disk may be mounted in the discharge apparatus of the invention between the free end of the connecting chamber and a fastening flange of the enclosing pipe, said disk containing a sealing feed-through for the discharge pipe and filling the annular space formed between the discharge pipe and the enclosing pipe in the axial direction as far as the inlet of the intake pipe stub. This closing disk therefore is used to prevent dead spaces, namely to replace the dead spaces with the passage means.

In a further design of the discharge apparatus, the invention proposes to surround the discharge pipe within the connecting chamber in concentric manner and at a spacing by an immersion pipe of which the leading end is connected to the discharge pipe and is sealed at least in the area of the upstream end of the connecting chamber. Among the effects of this step is an advantageous transmission of the axial and radial displacement forces for the peeling motions of the discharge pipe and as regards the design, simplified ways of connecting the adjusting motors generating these motions.

The outer circumference of the immersion pipe can be guided both by an adjustment ring resting between the ends of the connectingchamber and by a slip ring mounted to the front end of the connecting chamber.

Further features and advantages of the invention are discussed in the description below of illustrative implementations of the method of the invention and of the discharge apparatus of the invention and of the latter's embodiments in relation to the drawings showing details essential to the invention. The features of the invention can be embodied singly or in arbitrary combinations. The Figures are shown in substantially schematic manner.

Figure 2:
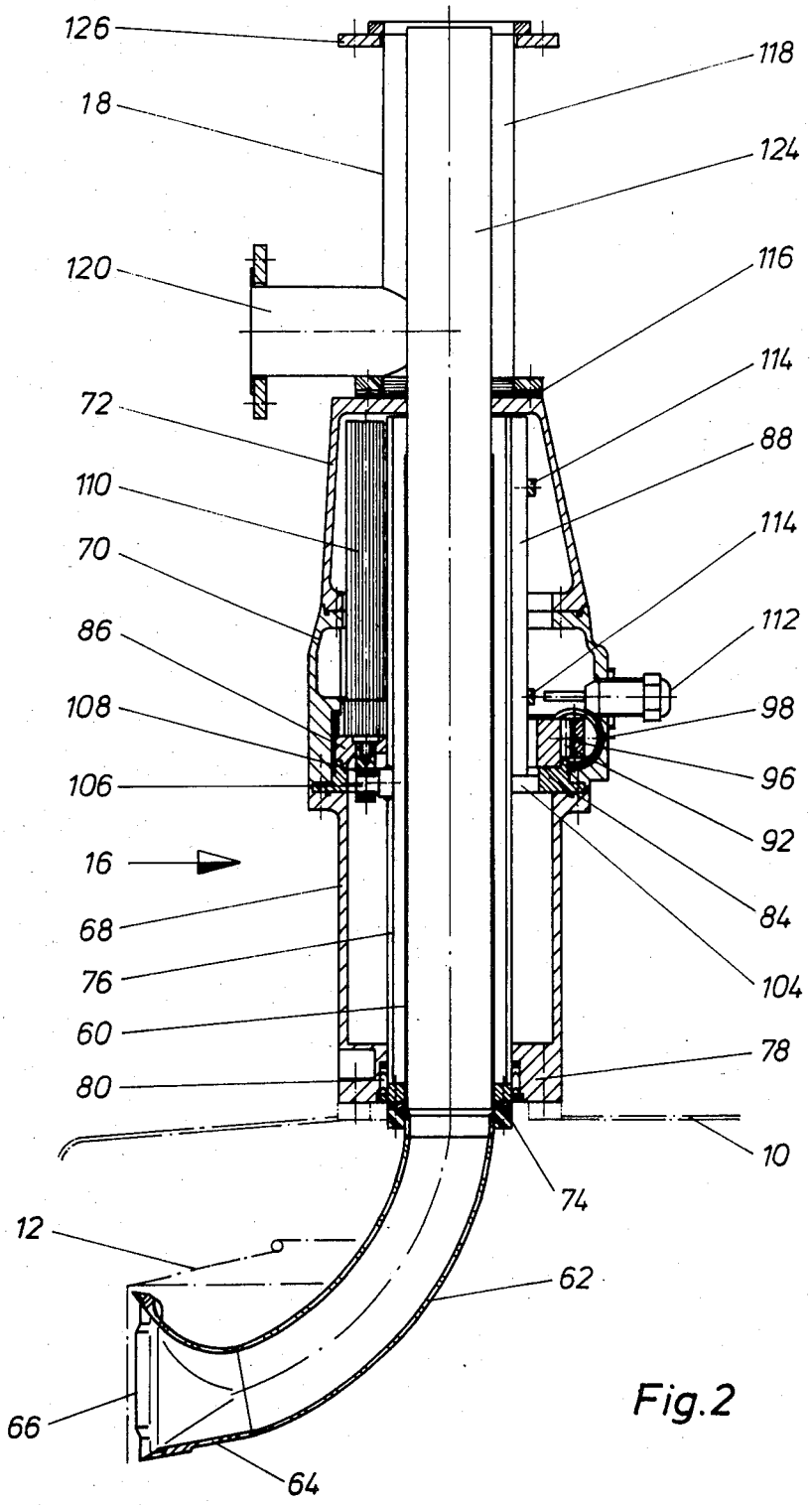
Figure 3:
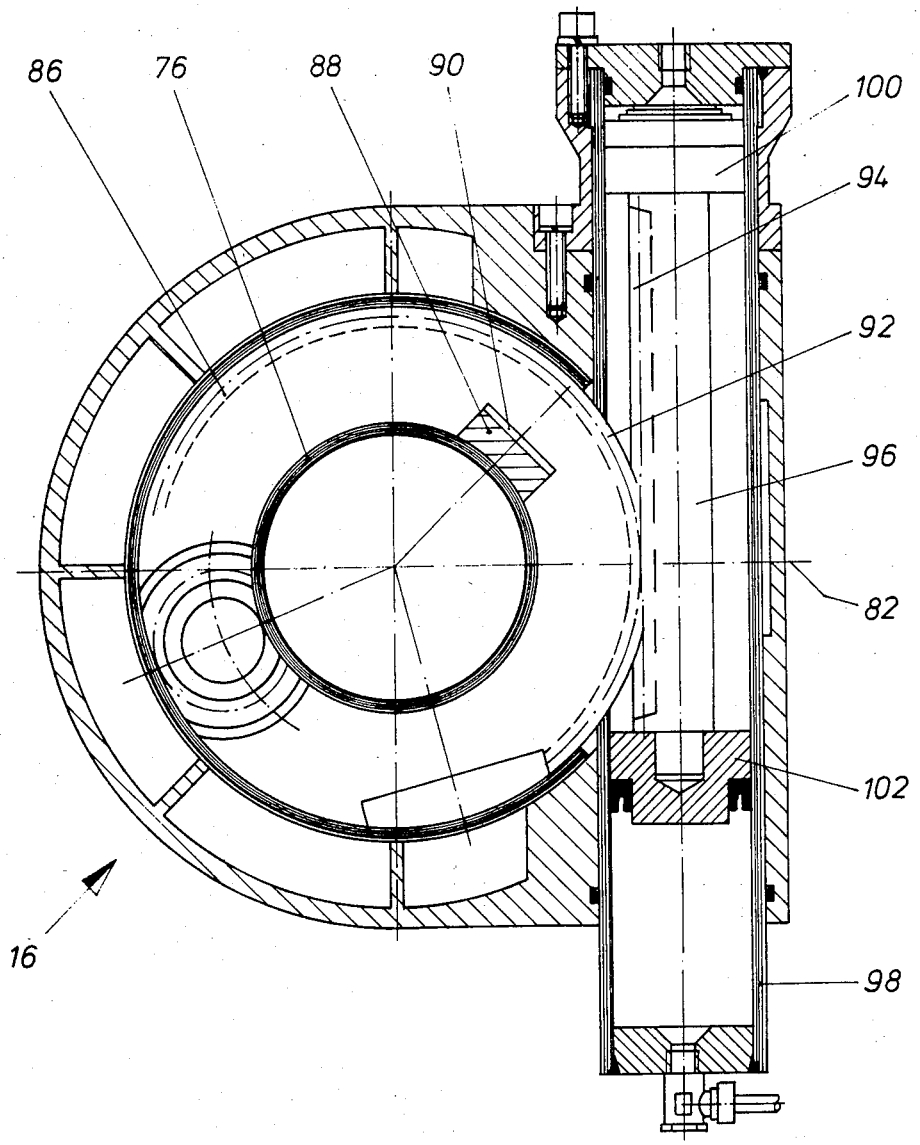

FIG. 1 is an overview of the pneumatic conveyance loop forming the discharge apparatus of the invention, FIG. 2 is a longitudinal section of the discharge housing mounted on a centrifuge housing, including the discharge pipe, the peeling elbow and the enclosing pipe for the secondary gas flow, and FIG. 3 is a horizontal section of the connecting chamber per FIG. 2 at the height of the drive jack for the rotation of the discharge pipe.

As shown in FIG. 1, a sealed centrifuge housing rests on a centrifuge frame 14 and encloses a pivotably supported centrifuging drum 12. A connecting chamber 16 is hermetically mounted on the top side of the sealed centrifuge housing 10, details of said chamber being further discussed below in relation to FIGS. 2 and 3. The connecting chamber 16 encloses a rotatable discharge pipe which is adjustable in height and of which the lower end continues in the form of a pipe elbow and a peeling head provided laterally and below with peeling blades. Very thin layers of product can be peeled by finely controlled radial and axial displacements of the discharge pipe and using the elbow in order to empty the centrifuge while the centrifuge housing 10 is closed, said layers being removed from the centrifuging drum driven at a suitable angular speed.

The peeling process is accompanied by a pneumatic conveyance, a heated drying gas being introduced through a primary flow branch 52 shown in FIG. 1 into the centrifuge housing, the discharge pipe being connected to a pneumatic suction line. As shown in FIG. 1, the centrifuge is included in a pneumatic conveyance loop comprising consecutive units and assemblies. An enclosing pipe 18 described in detail further below is also connected to the upper end of the connecting chamber 16; a drying pipe path 20 is joined by a compensating member not further detailed herein to said enclosing pipe 18 to remove the residual humidity from the peeled off product by means of the drying gas before this product is dropped, through a cyclone separator 22 with a filter 24 therein, dry into a bin 26. In the shown embodiment the bin 26 is designed to be a mixing container with a screw mixer 28.

The conveyance loop continues from the upper end of the cyclone separator 22 through the suction line 30, a safety filter 32 and into a condenser 34 where the carrier medium is rid of the entrained solvent vapors. A drop collector 36 follows.

The conveyance loop continues with a high-pressure blower 38 and a measuring and metering system whereby the residual content in solvent in the carrier medium can be set. To keep the ignitability of the mixture low and in order that the $O_2$ content remain somewhat less than 6%, an $N_2$ feed line is provided where necessary. The blower 38 is followed by a pressurized line 42 passing into a heater 44 which may be a heat exchanger. A bypass line 46 and a following mixing valve 48 permit fine-control temperature regulation of the drying gas presently ready for product treatment and now passing through a safety filter 50. The heated drying gas is split beyond a blocking and regulating valve 58 to form a primary flow passing through a primary branch 52 and a connector 56 at the centrifuge housing 10 into the centrifuge and a secondary flow passing through a secondary branch 54 into the enclosing pipe 18. The splitting ratio illustratively 1:3.

The enlarged representation of the connecting chamber 16 mounted on the centrifuge 10 of FIG. 2 indicates its appropriate division—for reasons of simplified manufacture, maintenance and repairs—into a lower section 68, a central section 70 and an upper section 72. A discharge pipe 60 passes through the connecting chamber 16 and continues at its lower end by an elbow 62 to which is mounted a peeling head 64 with a flaring opening revealing one lateral peeling blade 66. The discharge pipe 60 is connected by a lower flange means 74 to an immersion pipe 76 of larger diameter.

In the upper position of the discharge pipe retracted into the connecting chamber 16, the immersion pipe 76 essentially extends to the upper inside end of this connecting chamber, whereby an adequate support length remains inside the connecting chamber in the advanced state. The immersion pipe 76 is guided in gas and dust hermetic manner on both sides of a seal 80 at its circumference in the area of the lower end of the connecting chamber at 78.

A support ring 84 is clamped between the lower section 68 and the central section 70 of the connecting chamber to support an adjustment ring 86 pivotably supported at the circumference. The support ring 84 and the adjustment ring 86 enclose with bearing play the immersion pipe 76, whereby an advantageously large spacing of the support means or guide means of the support pipe is provided as regards the lower guide means 80 in the connecting chamber.

As also shown by FIG. 3, an adjustment spring 88 is mounted on the circumference of the immersion pipe 76, extending through a clearance 90 of the adjustment ring 86 and acting as a drive connection between the adjustment ring and the immersion pipe. The adjustment ring 86 is provided with a peripheral toothing 92 over parts of its periphery, engaging a gear-rack 94. The gear-rack 94 is part of a piston rod 96 of a hydraulic cylinder 98 and comprises a piston 100, 102 at both ends. If the cylinder 98 is loaded at one end as shown in FIG. 3, then the piston motion rotates the adjustment ring 86 until the radius passing through the center of the adjustment spring 88 is on the axis 82. In that position the adjustment spring 88 is flush with a clearance 104 in the support ring underneath and hence can be moved downward.

A drive cylinder 110 to axially displace the discharge pipe 60 is mounted in axially parallel manner to the discharge pipe on the adjustment ring 86 within the connecting chamber 16, the piston rod of said cylinder 110 passing through openings in the adjustment ring and the support ring and being linked by means of a piston rod eye 108 to a drive attachment 106 mounted on the immersion pipe 76. FIG. 2 further indicates a proximity switch 112 and reading marks 114 associated with this switch which are on the adjustment spring 88; this switch 112 emits signals to the operator for the end positions of the longitudinal displacement.

As shown in FIG. 2, the discharge pipe 60 extends through an opening in the upper section 72 of the connecting chamber 16 into the enclosing pipe 18 with which it forms an essentially concentric annular space 118. The upward projecting length of the discharge pipe 60 from the connecting chamber 16 is approximately determined by the vertical adjustment stroke corresponding to the drive cylinder 110 to totally evacuate the centrifuging drum, and also depends on an additional residual length. This residual length is indicated in FIG. 2 by the broken line 124 and it assures that the discharge pipe 60 when in the extended end position still shall be enclosed by an annular space 18 before the secondary flow of the drying gas being introduced through the intake pipe stub 120 connected to the enclosing pipe 18 can come into contact with the mixture of product and gas issuing from the upper end of the discharge pipe.

The enclosing pipe 18 is hermetically sealed by its lower flange 122 on a closing disk 116, illustratively consisting of PTFE, to the connecting housing 16. The closing disk 116 projects upward into the annular space 118 until snugly against the lower edge of the intake pipe stub 120. The closing disk in this manner forms an axially extended guide means and a seal for the ground and polished outer circumference of the discharge pipe 60. The upper flange 126 of the enclosing pipe 18 joins for instance the curved drying path 20 shown in FIG. 1.

I claim:

1. A method for evacuating centrifuges, wherein the centrifuged product being peeled from the wall of a rotating centrifuging drum is fed to a discharge pipe passing through a closed centrifuge housing, comprising the steps of:

providing a primary flow of heated drying gas and a secondary flow of heated drying gas;

feeding said primary flow into the centrifuge housing as carrier fluid for conveying said product into said discharge pipe;

transforming said secondary flow of drying gas into a turbulent longitudinal flow essentially concentrically enclosing said discharge pipe adjacent a downstream end portion thereof;

and uniting said mixture of product and heating gas of the primary flow conveyed through said discharged pipe with said turbulent flow along a tubular product drying distance.

2. A method for evacuating centrifuges as set forth in claim 1, including the steps of:

circulating drying gas in a closed conveying loop through the drying path (20) which joins with the intake of the secondary flow;

passing the drying gas through a product separator (22) and through a condensing path (34), and reheating the drying gas before it is separated into a primary and a secondary flow.

3. A method for evacuating centrifuges as set forth in claim 2, including the step of circulating the drying gas in a closed loop by a high pressure blower, and maintaining a temperature control of the drying gas prior to its being split into primary and secondary flows.

4. A method for evacuating centrifuges as set forth in claim 1, including the step of circulating the drying gas in a closed loop by a high pressure blower, and maintaining a temperature control of the drying gas prior to its being split into primary and secondary flows.

5. A method for evacuating centrifuges as set forth in claim 1, including the step of splitting the heated drying gas into approximately equal volume flows.

6. A pneumatic discharge apparatus for a vertical centrifuge peeling assembly, comprising a discharge pipe connected to the peeling assembly through which removed material is conveyed, a connecting chamber to which the discharge pipe is connected, a discharge pipe ejecting into the connecting chamber by a length corresponding to its axial adjustment stroke, said length being enclosed by an enclosing pipe connected to the connecting chamber, the free end of the discharge pipe merging into a drying path, a pipe stub connected to the connecting chamber at the upper end thereof and above the end of the discharge pipe for supplying a flow of drying gas to the stream of conveyed material passing through the discharge pipe.

7. The pneumatic discharge apparatus as set forth in claim 6, wherein:

the pipe stub is connected directly behind the free end of the connecting chamber.

8. The pneumatic discharge apparatus as set forth in claim 6, in which the intake pipe stub is connected essentially perpendicular to an enclosing pipe connected to the top of the connecting chamber.

9. The pneumatic discharge apparatus as set forth in claim 6, wherein:

a closing disk is mounted between the free end of the connecting housing and fills the annular space formed between the discharge pipe and an enclosing pipe which is connected to the top of the connecting housing.

10. A pneumatic discharge apparatus as set forth in claim 6, wherein:

an immersion pipe is disposed within the connecting chamber and concentrically arranged with respect to the discharge pipe and extends upwardly out of the connecting housing and into an enclosing pipe from which it is concentrically spaced.

11. The pneumatic discharge apparatus as set forth in claim 10, wherein:

the outer circumference of the immersion pipe is guided both by an adjustment ring supported between the ends of the connecting chamber, and by a slip ring mounted at the intake end of the connecting chamber.

12. A pneumatic discharge apparatus as set forth in claim 10, wherein:

rotational drive means is connected to a discharge pipe within the connecting chamber for providing rotational movement thereof.

13. A pneumatic discharge apparatus as set forth in claim 12, wherein:

the rotational drive means includes includes a piston rod designed as a gear rack and is connected to an adjustment cylinder.

* * * * *